US005595520A

United States Patent [19]

Piascinski et al.

[11] Patent Number: 5,595,520

[45] Date of Patent: Jan. 21, 1997

[54] CATHODE-RAY TUBE PARTICLE REMOVAL APPARATUS AND METHOD

[75] Inventors: Joseph J. Piascinski, Leola; Eric E. Fritz, Lititz; Morton J. Nierenberg; Leonard P. Wilbur, Jr., both of Lancaster; Leroy W. Horn, Pottstown, all of Pa.

[73] Assignee: Thomson Consumer Electronics, Inc., Indianapolis, Ind.

[21] Appl. No.: 424,948

[22] Filed: Apr. 19, 1995

[51] Int. Cl.[6] ..... H01J 9/38

[52] U.S. Cl. ..... 445/59; 445/60

[58] Field of Search ..... 445/59, 60

[56] References Cited

U.S. PATENT DOCUMENTS

| | | | |
|---|---|---|---|
| 4,373,944 | 2/1983 | Glick et al. | 65/23 |
| 4,605,379 | 8/1986 | Shahan | 445/59 |
| 4,678,448 | 7/1987 | Booth et al. | 445/60 |
| 5,312,280 | 5/1994 | Kloba et al. | 445/59 |

FOREIGN PATENT DOCUMENTS

| | | | |
|---|---|---|---|
| 4-349329 | 12/1992 | Japan | 445/59 |
| 5-54801 | 3/1993 | Japan | 445/59 |

*Primary Examiner*—P. Austin Bradley
*Assistant Examiner*—Jeffrey T. Knapp
*Attorney, Agent, or Firm*—Joseph S. Tripoli; Dennis H. Irlbeck; Vincent J. Coughlin, Jr.

[57] ABSTRACT

The invention relates to an apparatus (70) and method for removing particles from an interior of a CRT envelope (12). The CRT envelope includes a faceplate panel (14), with a color selection electrode assembly (30) detachably mounted therein, sealed to a funnel (18). The apparatus comprises a plurality of thumper mechanisms (84, 184 and 284) for imparting asynchronous vibrations to the funnel of the envelope while the interior of the funnel is flushed with a suitable fluid. The embodiment further includes a plurality of vibrators (51) for imparting asynchronous vibrations to the color selection electrode assembly to remove particles therefrom, before the color selection electrode assembly is mounted into the panel and sealed to the funnel. A method for removing particles using the apparatus also is described.

10 Claims, 4 Drawing Sheets

CATHODE-RAY TUBE PARTICLE REMOVAL APPARATUS AND METHOD

The present invention relates to an apparatus and method for removing particles from a color selection electrode assembly comprising a frame and a color selection electrode, and also from within a cathode-ray tube (CRT) prior to a step in the manufacturing process in which a stem, containing an electron gun, is sealed into a neck portion of the CRT funnel.

BACKGROUND OF THE INVENTION

A CRT, such as a color picture tube or a color display monitor, includes a phosphor screen which is composed of different color-emitting phosphor elements, each of which emits a different color of light when impacted by electrons. The phosphor elements are formed on an interior surface of a faceplate panel by one of the known screen processing techniques. In the formation of the phosphor elements, the color selection electrode assembly is used as a photographic master. The color selection electrode has a plurality of small apertures therethrough to facilitate screening printing, and also to permit the passage of electron beams during the operation of the CRT. The color selection electrode assembly is detachably mounted within the faceplate panel, in proximity to the phosphor screen, by affixing the frame thereof to mounting means secured to the faceplate panel. During the screen processing operation, the color selection electrode assembly is inserted into and removed from the faceplate panel a number of times, thereby increasing the probability that phosphor, glass, or metal particles may become attached to the surface of the color selection electrode or block some of the apertures. After the screening operation, a thin metal film, such as aluminum, is deposited over the phosphor elements to reflect light emitted therefrom outwardly through the faceplate. The metal film also provides an electrode to which an electron accelerating potential can be applied. The faceplate panel is then frit sealed to a funnel portion of the CRT envelope, at an elevated temperature, in a suitable sealing furnace. When the sealed panel-funnel assembly leaves the sealing furnace, it cools and pulls in air. This greatly enhances the possibility that airborne contaminants, such as glass particles, metal flakes, dust particles, small fibers, etc., can be introduced into the envelope and block the apertures of the color selection electrode, or become lodged in gaps between the color selection electrode and the frame.

In the operation of the CRT, an electron beam is provided for each of three primary color-emitting phosphors. The three electron beams converge at the color selection electrode and pass through the apertures thereof and impact a phosphor of the proper light-emitting color. If an aperture of the color selection electrode is blocked by a conductive particle, an objectionable spot is apparent on the screen. On the other hand, insulative particles, which are charged negatively by the electron beams, will cause deflection of the beams by coulomb repulsion. Therefore, the insulative particles can cause picture imperfections, such as screen spots, when attached to the color selection electrode without physically blocking the apertures. Furthermore, it has been observed that the insulative particles, in addition to causing screen spots, also cause color misregister of the electron beams. The color misregister creates a "halo" effect resulting from the electron beams being deflected by the negatively charged particles and striking the phosphor elements adjacent to the obscured region. Additionally, the conductive particles can fall into the electron gun of the completed tube and cause electrical shorts or arcing.

It is known in the art to attempt to dislodge the objectionable particles by thumping the faceplate panel or ultrasonically vibrating the envelope while purging the envelope with a charged fluid, such as ionized air; however, such expedients have not substantially reduced the number of objectionable particles, as found by analyzing tubes rejected for particle-related problems.

SUMMARY OF THE INVENTION

The invention relates to an apparatus and method for removing particles from an interior of a CRT envelope. The CRT envelope includes a faceplate panel, with a color selection electrode assembly detachably mounted therein, sealed to a funnel. The apparatus comprises a plurality of thumper mechanisms for imparting asynchronous vibrations to the funnel of the envelope while the interior of the funnel is flushed with a suitable fluid. The invention further includes a plurality of vibrators for imparting asynchronous vibrations to the color selection electrode assembly to remove particles therefrom, before the color selection assembly is mounted into the panel and sealed to the funnel.

BRIEF DESCRIPTION OF THE DRAWINGS

The invention will now be described in greater detail, with relation to the accompanying drawings, in which.

DETAILED DESCRIPTION OF THE PREFERRED EMBODIMENT

Figure 1:
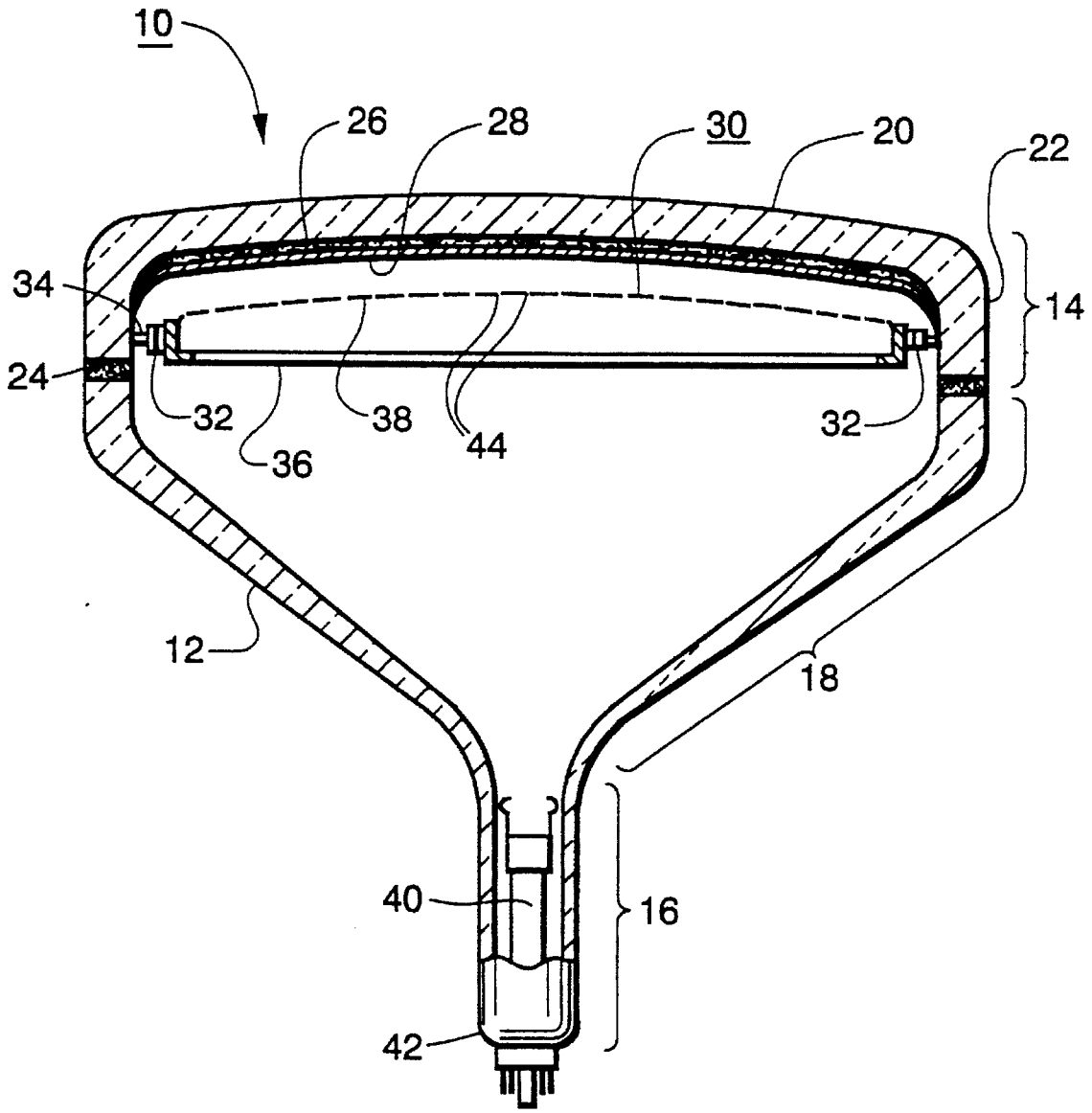
FIG. 1 is a plan view, partially in axial section, of a color CRT made using the apparatus of the present invention.

FIG. 1 shows a color CRT 10 having a glass envelope 12 comprising a rectangular faceplate panel 14 and a tubular neck 16 connected by a rectangular funnel 18. The panel 14 includes a viewing faceplate 20 and a sidewall 22. The sidewall 22 of the panel 14 is sealed to the funnel 18 by a frit seal 24. A luminescent three color phosphor screen 26 is provided on the inner surface of the viewing faceplate 20. The screen 26 may be a line screen or a dot screen which includes a multiplicity of screen elements comprised of red-emitting, green-emitting and blue-emitting phosphor elements arranged in color groups of three stripes or triads, respectively, in a cyclic order. A thin conductive layer 28, preferably of aluminum, overlies the screen 26 and provides means for applying a uniform potential to the screen, as well as for reflecting light, emitted from the phosphor elements, through the viewing faceplate 20. A multiapertured color selection electrode assembly 30 is detachably mounted, by means of a plurality of attachment members 32, to support studs 34 embedded in the sidewall 22 of the panel 14, in predetermined spaced relation to the screen 26. The color selection electrode assembly 30 comprises a frame 36 and a color selection electrode 38 which are welded together. The color selection electrode 38 may be a shadow mask, a tension mask, or a focus tension mask. As shown in FIG. 1, the color selection electrode 38 is a shadow mask which is welded inside the L-shaped frame 36. An electron gun 40 is centrally mounted on a stem 42 and sealed within the neck 16, to generate and direct three electron beams, not shown, along convergent paths, through apertures 44 in the mask 38, to the screen 26.

Figure 2:
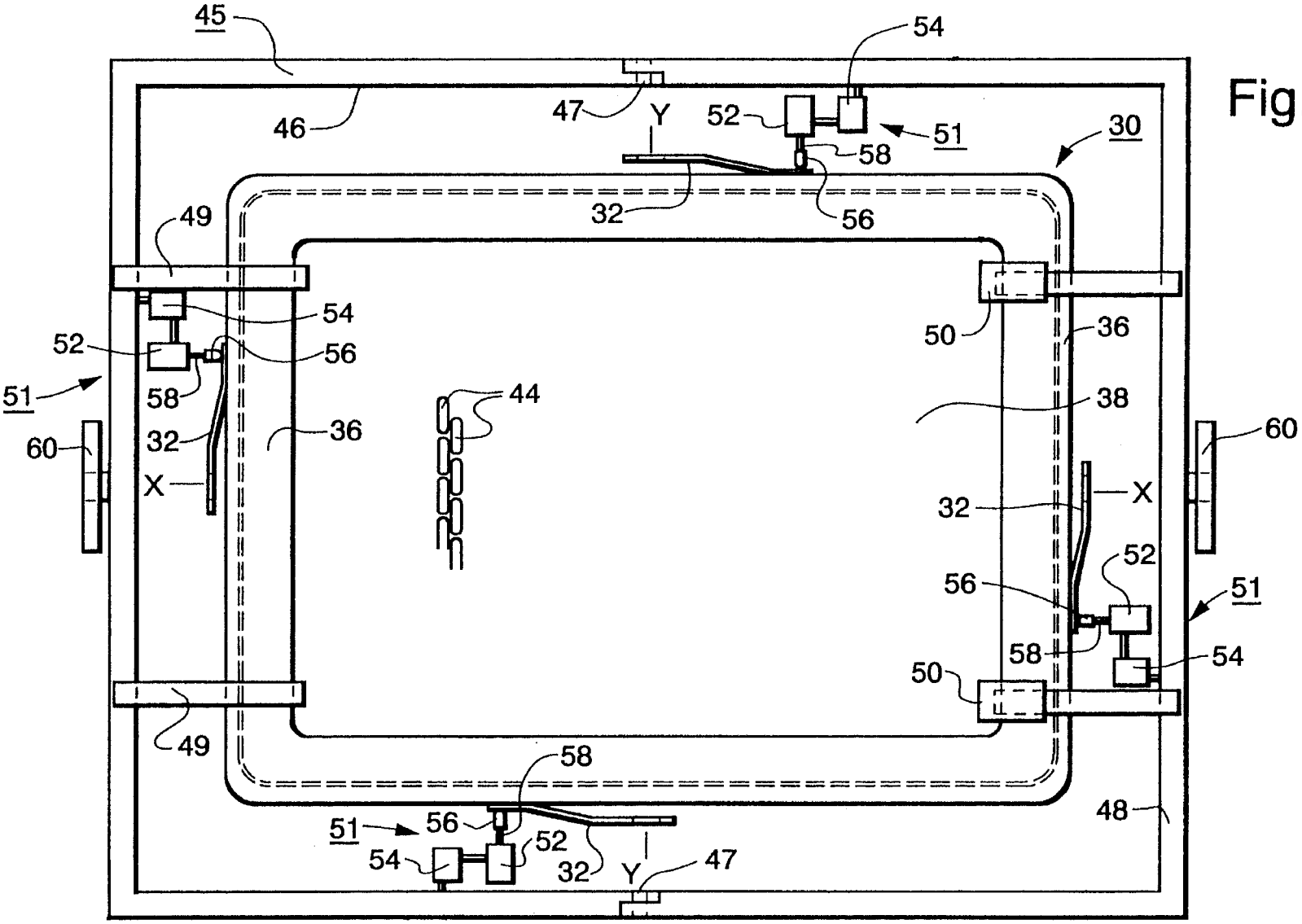
FIG. 2 is a schematic view of a color selection electrode assembly vibrator apparatus.

The color selection electrode assembly 30 is shown supported within a vibrating device 45, in FIG. 2. The color selection electrode vibrating device 45 includes a frame 46 with a pair of hinges 47 that permits one side 48 of the frame 46 to be raised to insert the color selection electrode assembly. A pair of fixed retainers 49 grasp and hold one side of the L-shaped color selection electrode frame 36. A pair of adjustable retainers 50 grasp and hold the other side of the L-shaped frame 36. A plurality of vibrators 51 are provided on the device 45. Each vibrator 51 includes an air cylinder 52 connected to an adjustable air frequency generator 54. Each air frequency generator 54 is independently adjustable of the other air frequency generators. The air frequency generators are available from Penn Air Company, York, Pa. A hammer 56 is connected to the air cylinder 52 by a support rod 58. The number of vibrators 51 is determined by the number of attachment members 32 used to secure the color selection electrode assembly within the faceplate panel (not shown in FIG. 2). Preferably, one vibrator 51 is used at the point at which the attachment member 32 is secured to the frame 36 of the color selection electrode assembly. The air frequency generators 54 are adjusted to tap independently of each other to provide asynchronous vibrations to the assembly 30. The asynchronous vibrations prevent destructive interference between the tapping devices that would otherwise occur if the vibrations should be improperly phased. The assembly 30 may be vibrated at any number of steps in the manufacturing operation; however, for expediency, the assembly should be vibrated at least before the final insertion, or mounting, into the faceplate panel 14.

To maximize the efficiency of the vibration of the assembly 30, the assembly is inverted so that particles trapped between the color selection electrode 38 and the frame 36 may be more easily dislodged, with the assistance of gravity. The device 45 is inverted by rotating the device about a pair of oppositely disposed support members 60.

The efficiency of the novel color selection electrode vibrating device 45 has been demonstrated by vibrating six color selection electrode assemblies 30 that previously had been subjected to a conventional panel/mask frame assembly thumper and flush device (not shown) of the type described in U.S. Pat. No. 4,605,379, issued to Shahan, on Aug. 12, 1986. The device of that patent includes a plurality of thumper arms that alternately impact the center of the faceplate panel 14. During the thumping operation, charged air is passed across the panel/frame mask assembly to charge the assembly and any particles adhering thereto because of static electricity. The like charges cause the particles to be repelled from the assembly and the combination of the charged air flush and thumping disengages particles from the assembly which otherwise could cause blocked apertures or possibly short-out the electron gun.

During the present test, six color selection electrode assemblies 30 were mounted in the device 45 and asychronously vibrated for 10 seconds. All the particles removed from the six assemblies 30 were segregated by particle type and counted. The process was repeated on the same six assemblies 30 a total of four times and the results are summarized in TABLE 1.

TABLE 1

| Particle Counts/description | Test #1 | Test #2 | Test #3 | Test #4 |
|---|---|---|---|---|
| Dirt | 100 | 35 | 25 | 24 |
| Conductive Coating | 21 | 0 | 4 | 1 |
| Plastic | 6 | 0 | 1 | 3 |
| Glass | 49 | 8 | 3 | 11 |
| Blackening | 42 | 12 | 10 | 10 |
| Weld Splash | 1 | 0 | 0 | 0 |
| Metal | 2 | 1 | 0 | 1 |
| Avg. Particle/Assembly | 30 | 9 | 7 | 8 |

An analysis of the particles removed by each successive vibration test of the assemblies 30 indicated that the first test not only removed the greatest number of particles, but that the greatest number of particles with a size >0.05 mm were removed during the first test. It is evident that the present process of directly vibrating the assembly 30 is more efficient in removing particles than the prior process, described in U.S. Pat. No. 4,605,379, that thumped and flushed the assembly 30 when the assembly was mounted within the faceplate panel 14.

A device for removing glass from within the CRT envelope having a shadow mask assembly therein is described in U.S. Pat. No. 4,678,448, issued to Booth et al. on Jul. 7, 1987. The device strikes the center of the envelope faceplate panel using a striker similar to that described in U.S. Pat. No. 4,605,379.

Figure 3:
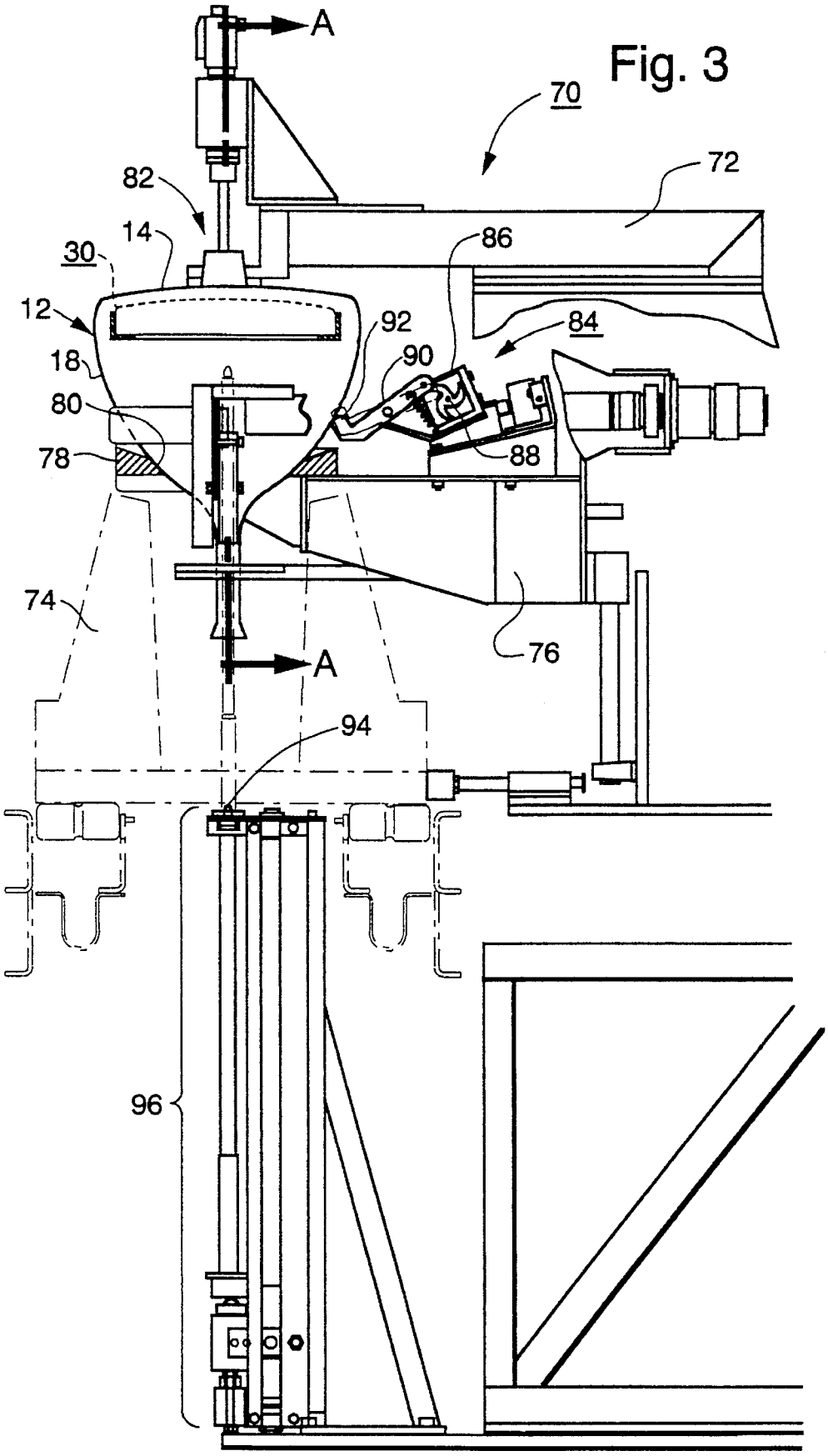
FIG. 3 is side view of a novel particle removal apparatus.
Figure 4:
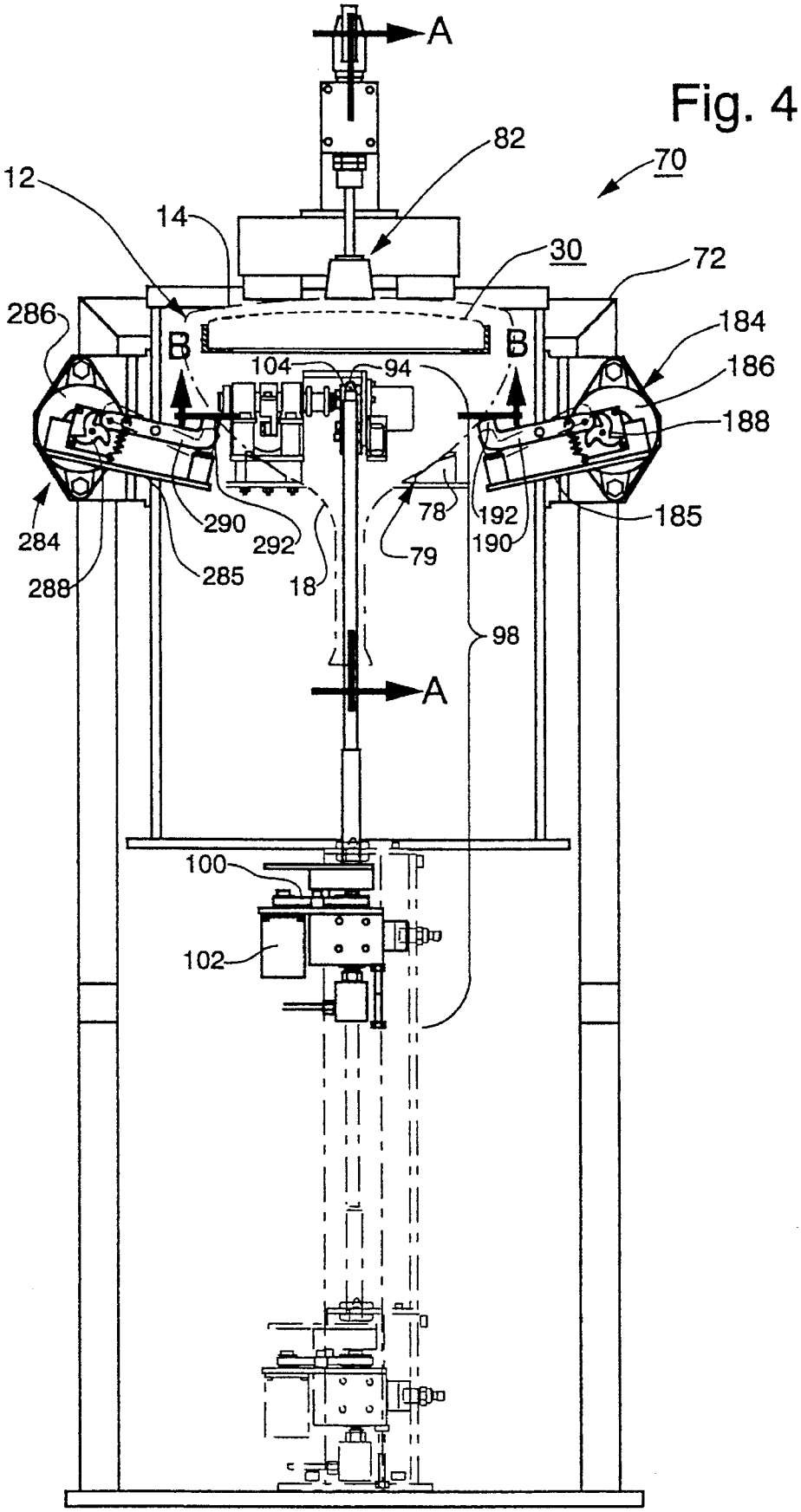
FIG. 4 is a front view of the apparatus of FIG. 3.

The efficiency of removing particles from the CRT envelope 12 is enhanced by the present particle removal apparatus 70, shown in FIGS. 3 and 4. With reference to FIG. 3, the novel particle removal apparatus 70 comprises a support frame 72 which is positioned adjacent to a conveyor system (not shown). A carrier 74 carries the CRT envelope 12 to a lift mechanism 76 of the apparatus which is moveable both horizontally and vertically. The lift mechanism 76 includes a support element 78, with a U-shaped opening 79, shown in FIG. 4. The support element 78 has a beveled surface 80, to receive and support the funnel 18 of the envelope 12. The lift mechanism 76, with the envelope 12 disposed within the support element 78, is shown in the elevated position in FIGS. 3 and 4. In this position, the faceplate panel 14 is adjacent to a pneumatic sand-ram 82, which is an improvement over the faceplate striker described in U.S. Pat. No. 4,678,448. The sand-ram 82, which is not part of the present invention, is actuated during the thumping operation described below to further assist in removing particles from within the envelope 12.

The particle removal apparatus 70 further comprises a first thumper mechanism 84, shown in FIG. 3, that includes a constant speed motor 86 connected to a three-lobed cam 88. The first thumper mechanism 84 is secured to the lift mechanism 76 so that it is raised to its operable position by the action of the lift mechanism. The start time of the motor 86 is adjustable by means of a programmable timer, not shown. The cam 88 raises a resilient hammer 90, having a striking surface 92 which contacts, or strikes, the funnel 18 of the envelope 12 at the 6 o'clock position. Preferably, the hammer 90 is made of a hard plastic that will not damage the envelope. For an envelope having a faceplate diagonal dimension of about 63 to 66 cm (25 to 27 in), the striking surface 92 contacts a tapered portion of the funnel 18 at a point about 18.4 to 19 cm (7.25 to 7.5 in) from the longitudinal axis A—A of the envelope. The contact point would, of course, be scaled up or down along the tapered portion of the funnel, depending on the size of the CRT envelope being processed. When the envelope 12 is in the elevated position, a rotatable air probe 94, is raised from a retracted position 96, shown in FIG. 3, to an operable position 98, shown in FIG. 4, within the envelope. The air probe 94 is attached by a belt 100 to a motor 102 so that the probe rotates about the longitudinal axis A—A of the envelope 12 and discharges a gas, such as air, through a plurality of radially directed openings 104 in the probe. The air provides a curtain which flushes loose particles from the interior of the funnel 18 of the envelope 12. The rotatable air probe is more effective than prior stationary probes in removing particles from the funnel because the air curtain, produced when the probe rotates, covers the entire inner surface of the funnel, whereas the air from the fixed probe follows preferred paths and does not sweep the entire inner surface of the funnel. The air may be ionized, as is known in the art, to electrostatically discharge any insulative particles within the envelope, however, this expedient is not necessary for the operation of the apparatus.

Two pivotal thumper mechanisms 184 and 284, shown in FIG. 4, are attached to the support frame 72 and are swung into position by means of stop members 185 and 285, respectively, when the envelope 12 is in the elevated position. The first pivotal thumper mechanism 184 includes a constant speed motor 186 which is connected to a three-lobed cam 188. The second pivotal thumper mechanism 284 also includes a constant speed motor 286 connected to a three-lobed cam 288. The start times of the motors 186 and 286 are adjustable by means of separate programmable timers, not shown. The cams 188 and 288 raise resilient hammers 190 and 290, having striking surfaces 192 and 292, to contact, or strike, the tapered portion of the funnel 18 of the envelope 12 at the 3 and 9 o'clock positions, respectively, in a plane B—B. The impact location for each of the thumpers is about 18.4 to 19 cm from the longitudinal axis A—A of the envelope. Each of the timers that control the motors 86, 186 and 286 is programmed to have different starting times, so that the resilient striking surfaces 92, 192 and 292 strike the funnel at slightly different times. This difference in striking times ensures that destructive, or canceling, vibrations are not produced. Applicants refer to the vibrations established by this method as asynchronous vibrations. Typically, the thumper mechanisms 84, 184 and 284 are operated for about 28 seconds. Simultaneously, the sand-ram 82 is operated to strike the center of the faceplate panel 14. The sand-ram is programmed to provide about twelve impacts per second. The number of strikes provided by each of the thumper mechanisms is determined by the speed of the motors 86, 186 and 286, but it is typically about three to four strikes per second.

The effectiveness of the present particle removal apparatus 70 has been demonstrated by an analysis of the number of particles remaining in envelopes alter use of the apparatus 70. In test #1, five envelopes of test group #1, having a diagonal dimension of 69 cm, were subjected to an air flush from the rotatable probe 94 and asynchronous vibrations produced by the three thumper mechanisms 84, 184 and 284 described above. Control group #1 also consisted of 5 envelopes of the same size as those used in test group #1. The envelopes of control group #1 were flushed using a stationary, i.e., non-rotating, probe and vibrated using only a single thumper (not shown) which struck the funnel at the 6 o'clock location, but further outward from the axis A—A than the three thumping mechanisms of the present invention. The thumper for control group #1 also had only a two-lobed cam, whereas the cam of the present invention has three lobes to provide a greater number of strikes in the same time interval. The evaluation was repeated on two groups of test and control envelopes. The color shadow mask selection electrode assemblies 30 in all of the test groups were processed by asychronously vibrating the mask assembly according to the process described above.

The number of particles remaining in each envelope after processing was determined by fastening an aluminum dish to the flared end of the neck of the envelope 12 and pounding the faceplate of the envelope with a rubber mallet in the center of the faceplate and at the four corners. Then, the envelope was tilted at about a 30° angle and the funnel 18 was tapped with a nylon rod at the 3, 6, 9 and 12 o'clock locations to dislodge the particles into the aluminum dish. The particles were counted and the average number of particles per envelope is reported in TABLE 2.

TABLE 2

| Process | Test #1 (Avg. # of Particles) | Test #2 (Avg. # of Particles) |
|---|---|---|
| Control Group #1 | 25 | 16 |
| Test Group #1 | 10 | 7 |

The evaluation was repeated at a later date, using 20 test envelopes and two separate control groups of 20 envelopes each. All of the envelopes had a diagonal dimension of 69 cm or less. The envelopes of control group #2 received no thumping or flushing, whereas the envelopes of control group #3 were flushed using a stationary air probe and thumped using only a single thumper which struck the funnel at the 6 o'clock location. The 20 envelopes in test group #2 were processed using the novel apparatus 70, as described above. The particles were collected and counted as described above. The results are reported in TABLE 3.

TABLE 3

| Process | Remaining Particles/Envelope (Average) |
|---|---|
| Control Group #2 | 18 |
| Control Group #3 | 13 |
| Test Group #2 | 10 |

An evaluation was also made on very large size tube envelopes having a faceplate diagonal dimension of greater than 76 cm. Again, a test group and two control groups were utilized. The envelopes in control group #4 received no flushing or tapping, while the envelopes in control group #5 were flushed using a stationary probe and tapped using only a single thumper which struck the funnel at the 6 o'clock location. The envelopes in test group #3, were process using the apparatus 70 in the manner described above. The particles were collected and counted in the manner previously described. The results are provided in TABLE 4.

TABLE 4

| Process | Remaining Particles/Envelope (Average) |
|---|---|
| Control Group #4 | 12 |
| Control Group #5 | 8 |
| Test Group #3 | 4 |

In view of the above described evaluations, it is apparent that the novel apparatus 70, which utilizes three thumpers 84, 184 and 284, that asychronously vibrate the funnel 18 of the envelope 12 while injecting a curtain of air from a rotatable air probe into the interior of the envelope to flush the loosened particles therefrom, is more effective in reducing the number of particles that remain in the envelope after processing than conventional methods. It is believed that because the funnel 18 has a flatter taper along the 3 o'clock–9 o'clock axis than along the 6 o'clock–12 o'clock axis (compare, e.g., FIGS. 4 and 3), particles loosened during thumping tend to accumulate in the areas having the flatter taper. The present apparatus aggressively thumps the tapered portion of the funnel 18, not only at the 6 o'clock position but also at both the 3 and 9 o'clock positions, while providing a circulating air curtain which sweeps the loosened particles from the entire interior of the funnel. This structure removes more particles than the prior structure which vibrates only the center of the faceplate and utilizes a stationary probe that provides fixed streams of air along specific paths. The reduction in the number of particles remaining in an envelope processed using the novel apparatus means that fewer particles are available to either block the apertures in the shadow mask or fall into the electron gun of the finished tube where they could, if conductive, cause electrical shorts. Thus, the present apparatus improves the reliability of tubes made therewith.

What is claimed is:

1. An apparatus for removing particles from an interior of a CRT envelope, said envelope including a faceplate panel sealed to a funnel with a color selection electrode assembly detachably mounted within said faceplate panel, said apparatus comprising plurality of means for striking said funnel at similiar frequencies but at different times, thereby imparting asynchronous vibrations to said funnel of said envelope, and means for flushing the interior of said funnel with a suitable fluid.

2. The particle removal apparatus as described in claim 1, wherein said fluid is air.

3. The particle removal apparatus as described in claim 2, wherein said air is ionized.

4. The particle removal apparatus as described in claim 1, wherein said air is provided through a rotatable air probe having radially directed openings therein.

5. The particle removal apparatus as described in claim 1, further including a plurality of vibrators for imparting asynchronous vibrations to said color selection electrode assembly to remove particles therefrom, before said color selection electrode assembly is mounted into said panel and sealed to said funnel.

6. The particle removal apparatus as described in claim 1, wherein said plurality of means for striking said funnel at similiar frequencies but at different times includes a plurality of thumper mechanisms, each thumper mechanism communicating with a cam connected to a motor, each motor having a start time that is adjustable.

7. An apparatus for removing particles from an interior of a CRT envelope, said CRT envelope having a longitudinal axis, said envelope including a faceplate panel sealed to a funnel with a color selection electrode assembly detachably mounted within said faceplate panel by attachment means, said apparatus comprising a plurality of vibrators for imparting asynchronous vibrations to said color selection electrode assembly adjacent said attachment means to remove particles from said assembly prior to said assembly being mounted into said panel and sealed to said funnel, a plurality of thumper mechanisms for imparting asynchronous vibrations to said funnel of said envelope by striking said funnel at different points along a tapered portion thereof at similiar frequencies but at different times, said points lying in a plane transverse to the longitudinal axis of said CRT envelope, and means for flushing the interior of said funnel with air from a rotatable probe having a plurality of radially directed openings therein.

8. The particle removal apparatus as described in claim 6, wherein said air is ionized.

9. A method for removing particles from an interior of a CRT envelope, said CRT envelope having a longitudinal axis, said envelope including a faceplate panel sealed to a funnel with a color selection electrode assembly detachably mounted within said faceplate panel by attachment means, the method comprising the steps of:

mounting said color selection electrode assembly within said faceplate panel;

sealing said faceplate panel to said funnel; and imparting asynchronous vibrations to said funnel by striking said funnel at different points along a tapered portion thereof, said points lying in a plane transverse to said longitudinal axis of said CRT envelope, utilizing a plurality of thumper mechanisms while flushing the interior of said funnel with air from a rotatable probe.

10. The particle removal method as described in claim 9, further including an initial step, prior to mounting said color selection electrode assembly within said faceplate panel, of imparting asynchronous vibrations to said color selection electrode assembly adjacent to said attachment means to remove particles from said color selection electrode assembly.

* * * * *